US011072480B1

(12) United States Patent
Song

(10) Patent No.: US 11,072,480 B1
(45) Date of Patent: Jul. 27, 2021

(54) CONTAINER HAVING MULTIPLE COMPARTMENTS

(71) Applicant: Seungwoo Song, Ontario, CA (US)

(72) Inventor: Seungwoo Song, Ontario, CA (US)

( * ) Notice: Subject to any disclaimer, the term of this patent is extended or adjusted under 35 U.S.C. 154(b) by 0 days.

(21) Appl. No.: 16/813,278

(22) Filed: Mar. 9, 2020

(51) Int. Cl.
*B65D 81/32* (2006.01)
*B65D 43/16* (2006.01)

(52) U.S. Cl.
CPC ..... *B65D 81/3205* (2013.01); *B65D 43/162* (2013.01)

(58) Field of Classification Search
CPC ..... B65D 81/3205; B65D 43/162; B65D 2543/0024; B65D 43/169; B65D 21/0238; B65D 51/28; A47G 19/2205; A47G 19/2272
USPC ..... 220/23.83, 23.86, 23.87, 23.88, 23.89, 220/834, 799, 729, 521; 215/388, 229
See application file for complete search history.

(56) References Cited

U.S. PATENT DOCUMENTS 3,349,941 A * 10/1967 Wanderer ..... B65D 43/021 220/23.88
4,348,421 A * 9/1982 Sakakibara ..... A47J 47/14 206/217
4,478,346 A * 10/1984 Spong ..... A47G 19/2272 220/521
8,596,491 B2 * 12/2013 Buck ..... B65D 51/28 220/709
8,870,010 B2 * 10/2014 Buck ..... A47G 19/2205 220/23.83
8,939,312 B1 * 1/2015 Buck ..... B65D 43/162 220/521
9,078,535 B1 * 7/2015 Buck ..... A47G 19/2205
9,131,761 B2 * 9/2015 Kalyanpur ..... A45D 40/22
9,463,913 B2 * 10/2016 Strominger ..... B65D 51/28
10,442,595 B2 * 10/2019 Grove ..... B65D 77/0486
10,625,921 B2 * 4/2020 Johnson ..... B65D 21/0233
2005/0051549 A1 * 3/2005 Nelson ..... B65D 21/0219 220/23.83
2007/0278122 A1 * 12/2007 McCumber ..... B65D 81/3294 206/514
2010/0015293 A1 * 1/2010 Shapiro ..... B65D 1/34 426/87
2011/0210126 A1 * 9/2011 Vovan ..... B65D 43/162 220/574
2013/0008897 A1 * 1/2013 Rusnak ..... B65D 43/0231 220/23.89
2015/0239612 A1 * 8/2015 Wang ..... B65D 81/34 220/23.89
2020/0102571 A1 * 1/2020 Lubbe et al. ..... B65D 81/3216

* cited by examiner

*Primary Examiner* — J. Gregory Pickett
*Assistant Examiner* — Tia Cox

(57) ABSTRACT

The present invention provides a container having multiple compartments, the container comprising: a first container having a first interior volume; a second container having a bowl, a second interior volume defined by the bowl, and a lid, and inserted into and occupied a part of the first interior volume, wherein the second container includes a first engaging mean located along an inner edge of the bowl, and a second engaging mean located along an outer edge of the bowl; wherein the first engaging mean engages with a third engaging mean located along an edge of the lid, and wherein the second engaging mean engages with a fourth engaging mean located along an upper edge of the first container.

17 Claims, 11 Drawing Sheets

CONTAINER HAVING MULTIPLE COMPARTMENTS

FIELD OF THE INVENTION

The present invention pertains generally to the field of container, and more particularly to container having multiple compartments for storing different types of food.

BACKGROUND OF THE INVENTION

Many people in their busy lives have meals in restaurants or bring their lunch from home to offices or school. Accordingly, carrying food in box is common these days.

However, it is necessary for different kinds of food such as soup and rice to be stored separately to maintain them in their own flavor and taste. There are various conventional containers providing multiple compartments for different types of food; however, many structures require complexity or additional elements to gather multiple compartments to one body, or some do not even provide sealed space for soup.

Complicated structures can lead to increase manufacturing cost, volume, and weight, and these containers are not proper for to-go box.

SUMMARY OF THE INVENTION

The present invention provides a container having multiple compartments for storing different types of foods separately. According to the present invention, different types of food such as rice and soup can be stored in each of the first and the second container without mingling or spilling. At the same time, because the first and the second container are engaged with each other tightly and form one body, a user can carry the container conveniently. Also, a simple structure of the container enables low manufacturing cost, small volume, and light weight.

Embodiments of the inventive concept provide a container having multiple compartments. The container comprises a first container having a first interior volume; a second container having a bowl, a second interior volume defined by the bowl, and a lid, and inserted into and occupied a part of the first interior volume, wherein the second container includes a first engaging mean located along an inner edge of the bowl, and a second engaging mean located along an outer edge of the bowl; wherein the first engaging mean engages with a third engaging mean located along an edge of the lid, and wherein the second engaging mean engages with a fourth engaging mean located along an upper edge of the first container.

Embodiments of the inventive concept provide a container comprising a first container; a second container inserted into and occupied a part of an interior volume of the first container, the second container comprising: a bowl including one of a first engaging pair located along an inner edge, and one of a second engaging pair located along an outer edge, and a lid including the other of the first engaging pair located along an edge of the lid, wherein the first container includes the other of the second engaging pair located along an upper edge of the first container, and wherein, by the second engaging pair engaging each other, the first container and the second container are fixed to each other and the first container is sealed, and wherein by the first engaging pair engage each other, the second container is sealed.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTIONS

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as form "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
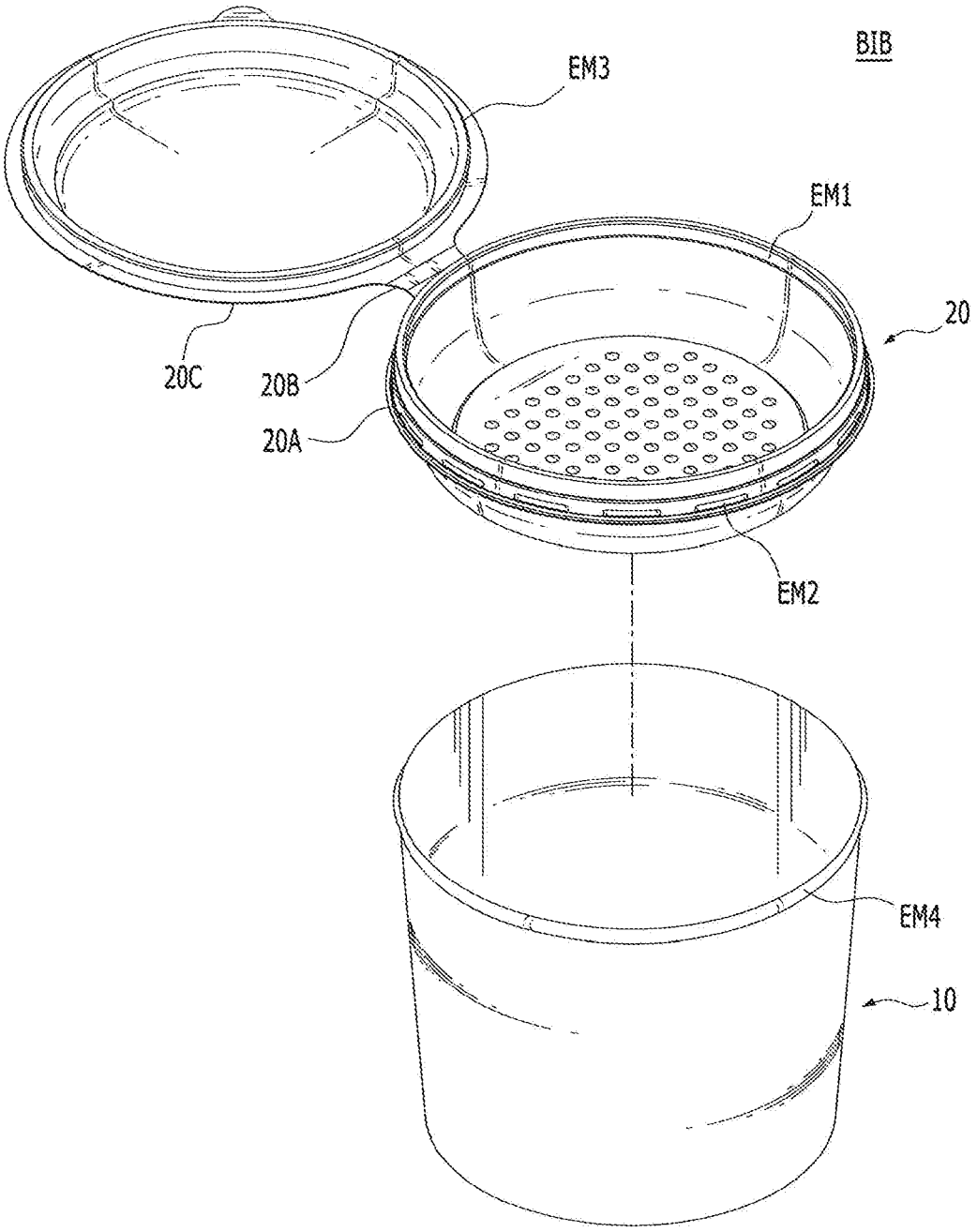
FIG. 1 shows an exploded perspective view of a container BIB having a first container 10 and a second container 20 according to one embodiment of the present invention.

FIG. 1 shows an exploded perspective view of a container BIB having a first container 10 and a second container 20 according to one embodiment of the present invention.

According to FIG. 1, the container BIB comprises the first container 10 and the second container 20. The first and the second container 10, 20 provide independent compartments, and each of the first and the second container 10, 20 is sealed by a first engaging pair and a second engaging pair, respectively. The first engaging pair includes a first and a third engaging mean EM1, EM3, and the second engaging pair includes a second and a fourth engaging mean EM2, EM4.

The second engaging pair also make the first and the second container 10, 20 combined with each other and enable them to be carried as one body, the container BIB.

Different types of food can be stored in each of the first and the second container 10, 20 without mingling or spilling. For example, the first container 10 may contain soup while the second container 20 contains rice or noodle. A user can carry soup and rice/noodle separately and eat them in their best condition. As another example, the first container 10 may contain topping while the second container 20 contain rice.

At the same time, because the first and the second container 10, 20 are engaged with each other tightly and form one body, a user can carry the container BIB conveniently.

Also, a simple structure of the container enables low manufacturing cost, small volume, and light weight.

Hereafter, the container BIB will be explained in more detail with reference to FIGS. 2 to 12 together.

Figure 2:
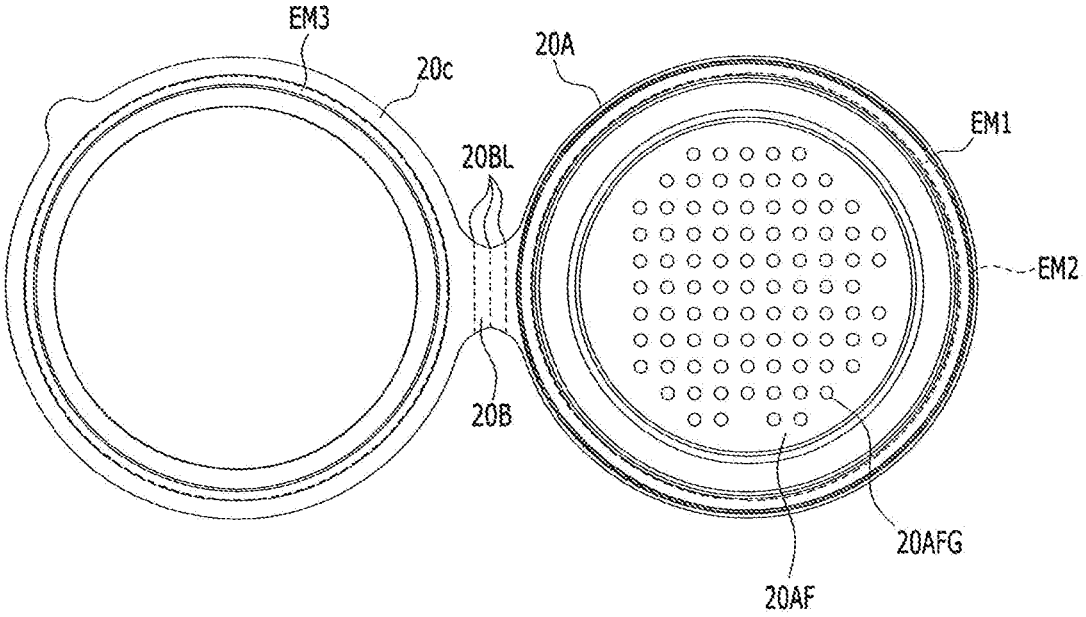
FIG. 2 shows a top view of the container BIB of FIG. 1 when the second container 20 is open.

FIG. 2 shows a top view of the container BIB of FIG. 1 when the second container 20 is open.

Figure 3:
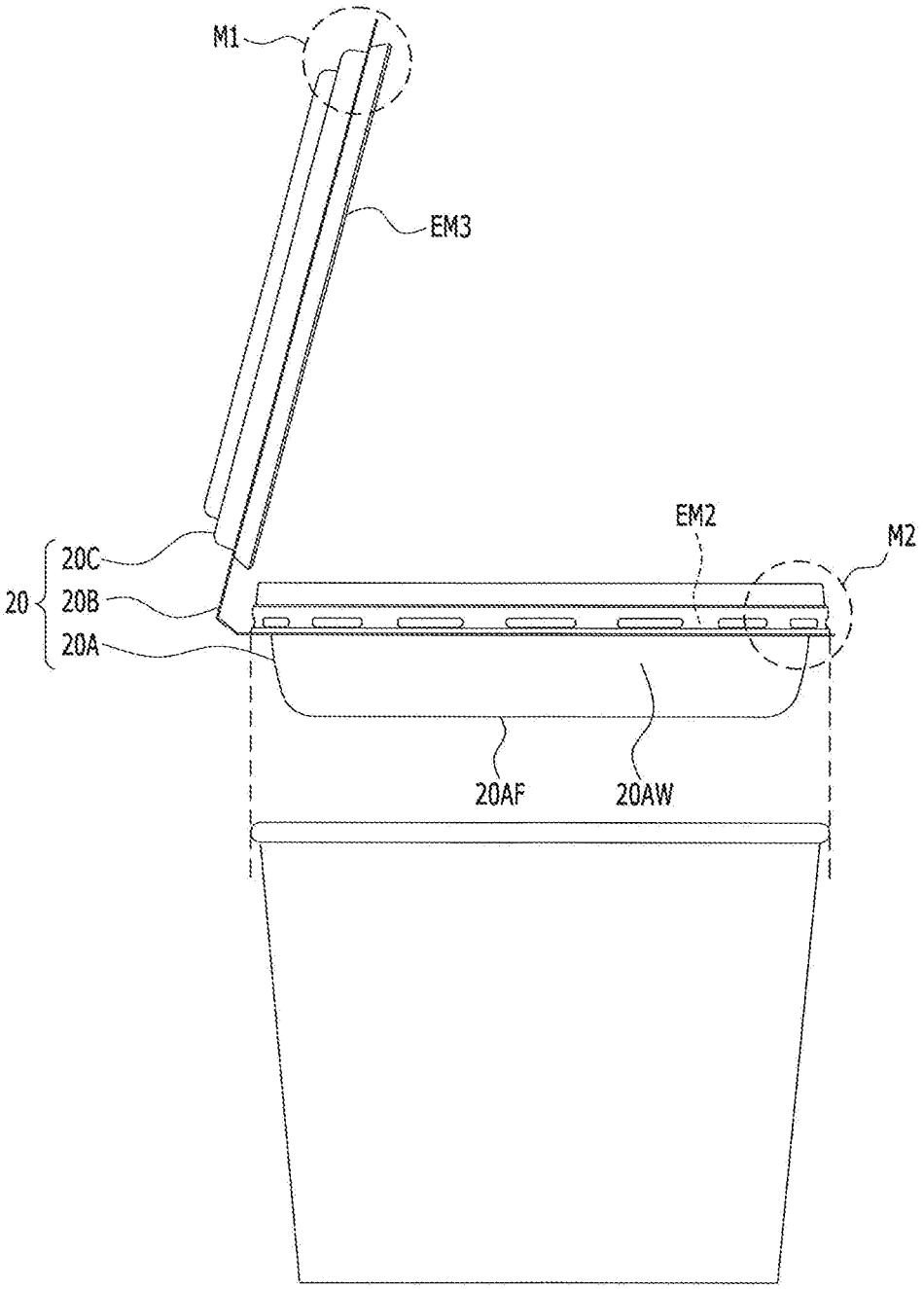
FIG. 3 shows a side view of the container BIB of FIG. 1 when the second container 20 is half open and the first and the second container 10, 20 are separated from each other.

FIG. 3 shows a side view of the container BIB of FIG. 1 when the second container 20 is half open and the first and the second container 10, 20 are separated from each other.

Figure 4A:
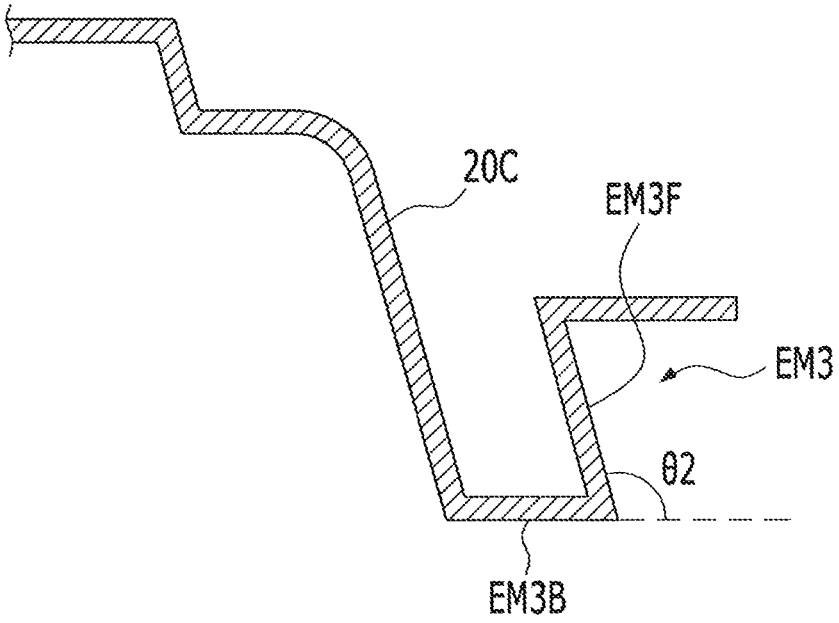
FIG. 4A shows a close-up sectional view of a portion M1 of the container BIB of FIG. 3.

FIG. 4A shows a close-up sectional view of a portion M1 of the container BIB of FIG. 3.

Figure 4B:
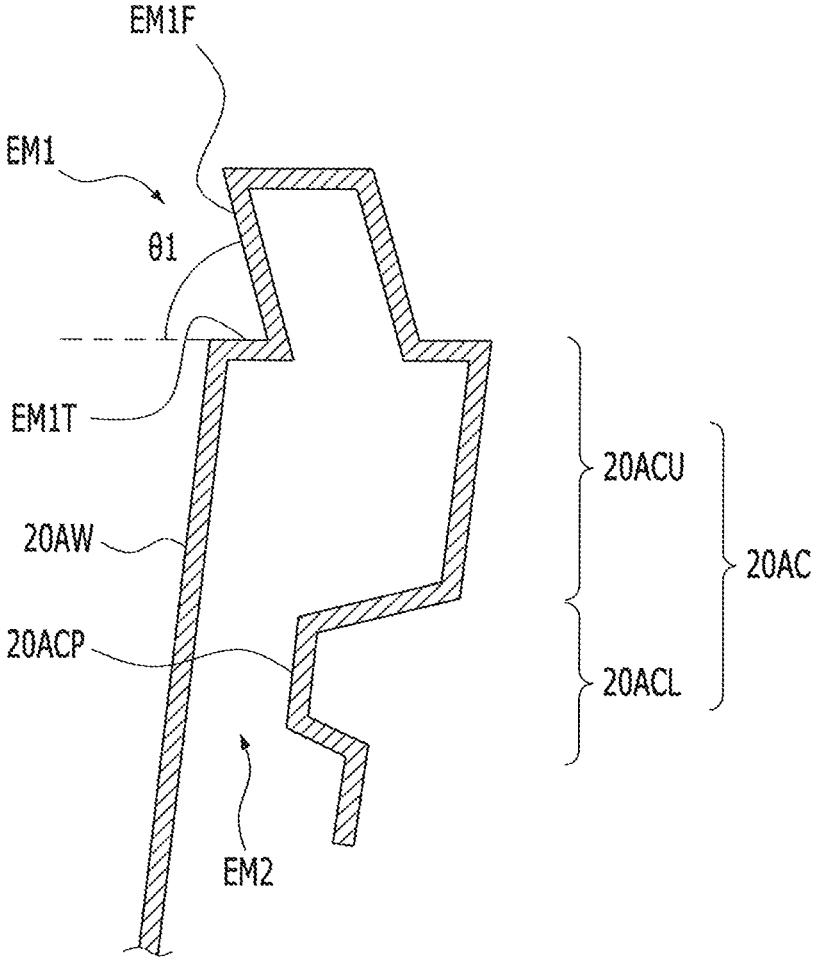
FIG. 4B shows a close-up sectional view of a portion M2 of the container BIB of FIG. 3.

FIG. 4B shows a close-up sectional view of a portion M2 of the container BIB of FIG. 3.

Referring to FIGS. 1 to 3, the first container 10 includes a floor, a sidewall extending upwardly from the floor, and a first interior volume defined by the floor and the sidewall. The first container 10 is described as a cup shape but is not limited to. In some embodiments, the first container 10 may be made of disposable paper but is not limited to.

There may be a rim rolled outwardly from a top end of the sidewall of the first container 10. The rim may work as the fourth engaging mean EM4. Thus, the rim working as the fourth engaging mean EM4 may engage with a groove, which works as the second engaging mean EM2, of the second container 20. This will be explained in more detail referring to FIGS. 4A and 4B.

The second container 20 includes a bowl 20A and a lid 20C covering an opening of the bowl 20A.

In some embodiments, the lid 20C may be connected to the bowl 20A through the bridge 20B. The bridge 20B may have at least one fold line 20BL and can be folded along the fold line 20BL. In some embodiments, the bowl 20A, the lid 20C, and the bridge 20B may be made of a same elastic material such as plastic but is not limited to.

Referring to FIGS. 3 to 4B, the bowl 20A includes a floor 20AF, a sidewall 20AW, a second interior volume, and an outer collar 20AC.

The floor 20AF may have a plurality of pits 20AG to prevent food, such as rice, from clinging to the floor 20AF. The sidewall 20AW extends upwardly from the floor 20AF and terminates at an opening of the bowl 20A. The second interior volume is defined by the floor 20AF and the sidewall 20AW. The outer collar 20AC extends outwardly from a top end of the sidewall 20AW.

The bowl 20A includes the first engaging mean EM1 and the second engaging mean EM2.

The first engaging mean EM1 is located along an inner edge of an upper portion of the sidewall 20AW. Referring to FIGS. 2 and 4B together, the first engaging mean EM1 may be a first groove formed along an inner circumference of an upper portion of the sidewall 20AW.

The second engaging mean EM2 is located along an outer edge of an upper portion of the sidewall 20AW. The second engaging mean EM2 may be a second groove formed between the side wall 20AW and the outer collar 20AC. Referring to FIGS. 2 and 4B together, the second groove working as the second engaging mean EM2 may be formed along an outer circumference of an upper portion of the sidewall 20AW.

In some embodiments, a gap distance between the side wall 20AW and the outer collar 20AC may be different between in a lower portion 20ACL and an upper portion 20CU. Specifically, a gap distance is narrower in a lower portion 20ACL than that in an upper portion 20ACU in at least part. In other words, the second groove may have a protrusion 20ACP projected toward the sidewall 20AW.

In some embodiments, there are at least two gap distances between the side wall 20AW and the outer collar 20AC. Accordingly, a cross section of the outer collar 20AC may be a square zig gap shape.

The lid 20C covers the opening of the bowl 20A. The lid 20C have a ceiling and a sidewall extending downwardly from the ceiling.

Referring to FIGS. 2 to 4A, the lid 20C includes a third engaging mean EM3 located along a lower edge of the sidewall of the lid 20C. The third engaging mean EM3 may has a protrusion shape (See FIG. 4A) engageable with the first engaging mean EM1, a first groove (See FIG. 4B).

Figure 5:
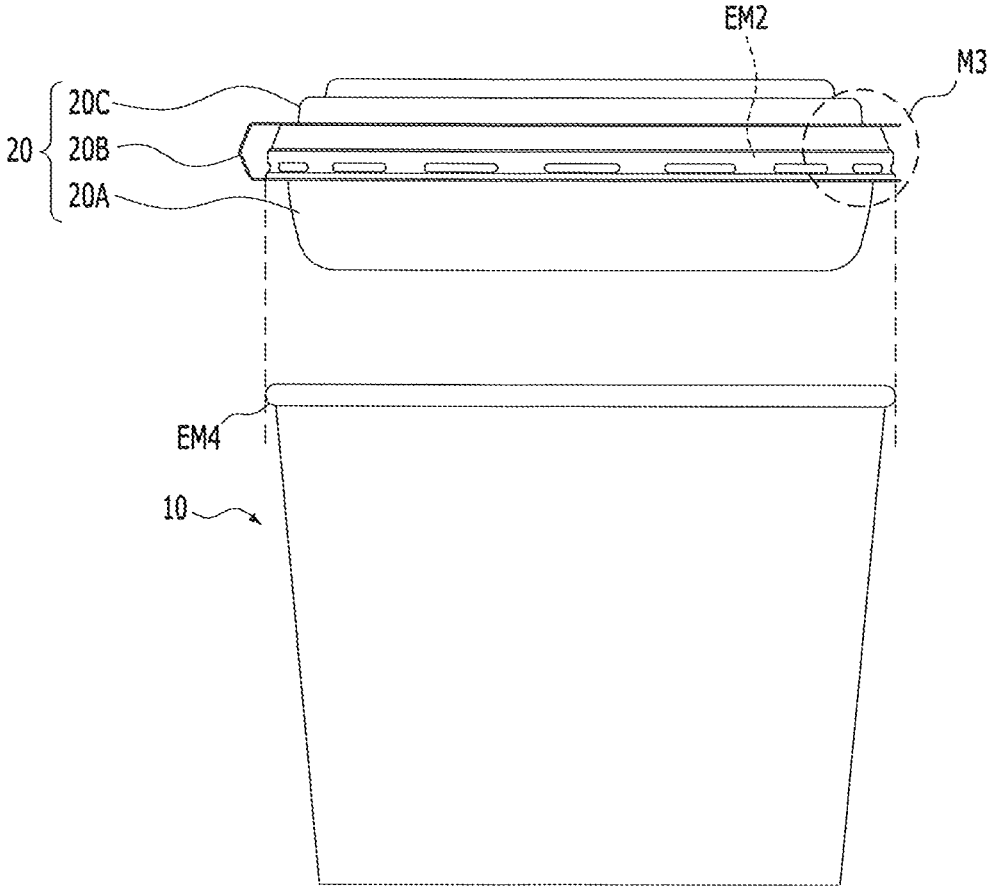
FIG. 5 shows a side view of the container BIB of FIG. 1 when the second container 20 is closed and the first and the second container 10, 20 are separated from each other.

FIG. 5 shows a side view of the container BIB of FIG. 1 when the second container 20 is closed and the first and the second container 10, 20 are separated from each other.

Figure 6:
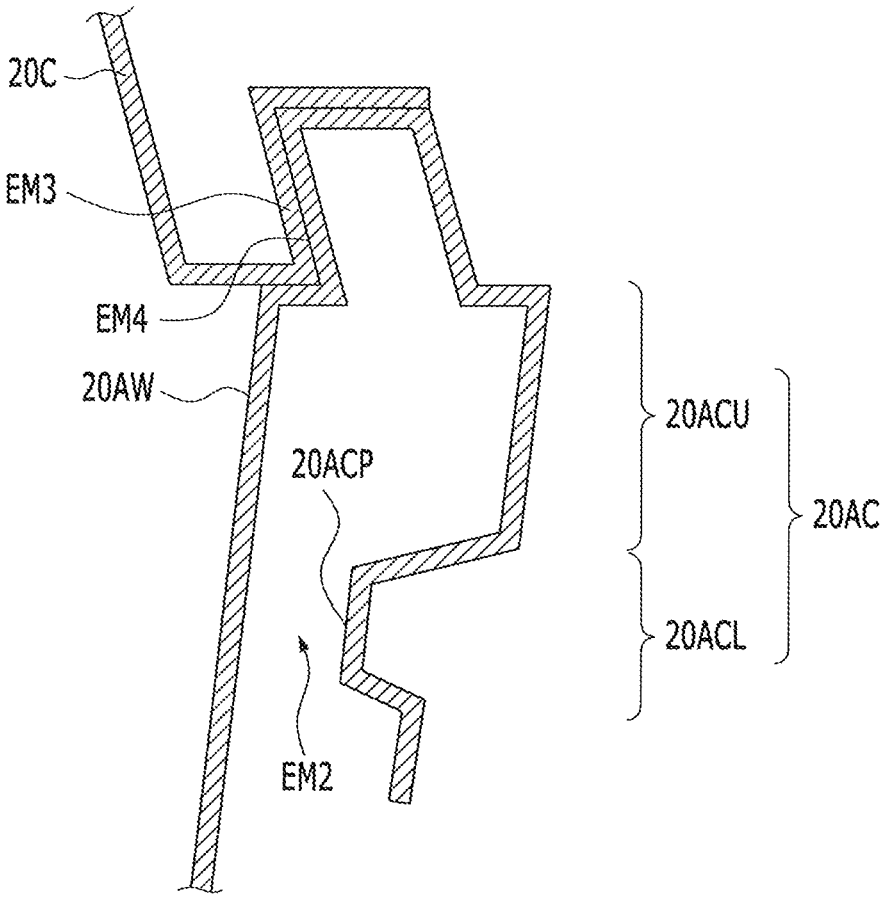
FIG. 6 shows a close-up sectional view of a portion M3 of the container BIB of FIG. 5.

FIG. 6 shows a close-up sectional view of a portion M3 of the container BIB of FIG. 5.

Referring to FIGS. 4A to 6, the first engaging mean EM1, the first groove, may be a step shape having a thread EM1T and a front face EM1F.

In some embodiments, an angle θ1 between the tread EM1T and the front face EM1F is acute. In this case, the third engaging mean EM3 may be a protrusion shape having a bottom EM3B and an outer face EM3F, and an angle θ2 between the bottom EM3B and the outer face EM3F may be obtuse.

Accordingly, the first and the third engaging mean EM1, EM3 can be engaged with each other tightly, and thereby the bowl 20A can be sealed by the lid 20C.

Figure 7:
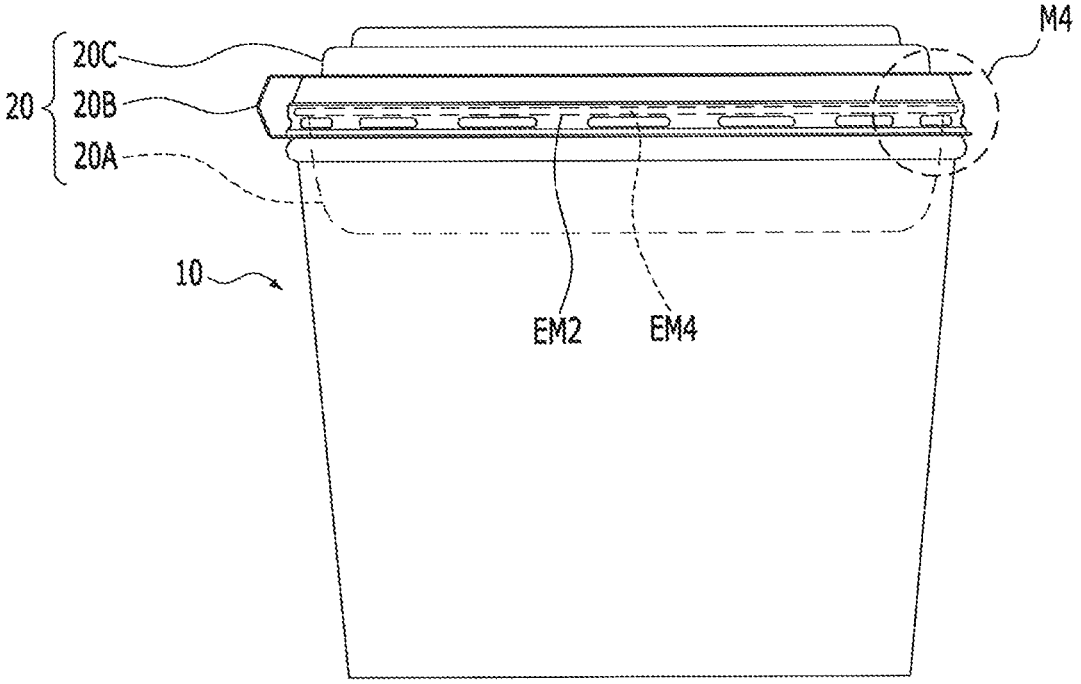
FIG. 7 shows a side view of the container BIB of FIG. 1 when the second container 20 is closed and the first and the second container 10, 20 are combined with each other.

FIG. 7 shows a side view of the container BIB of FIG. 1 when the second container 20 is closed, and the first and the second container 10, 20 are combined with each other.

Figure 8A:
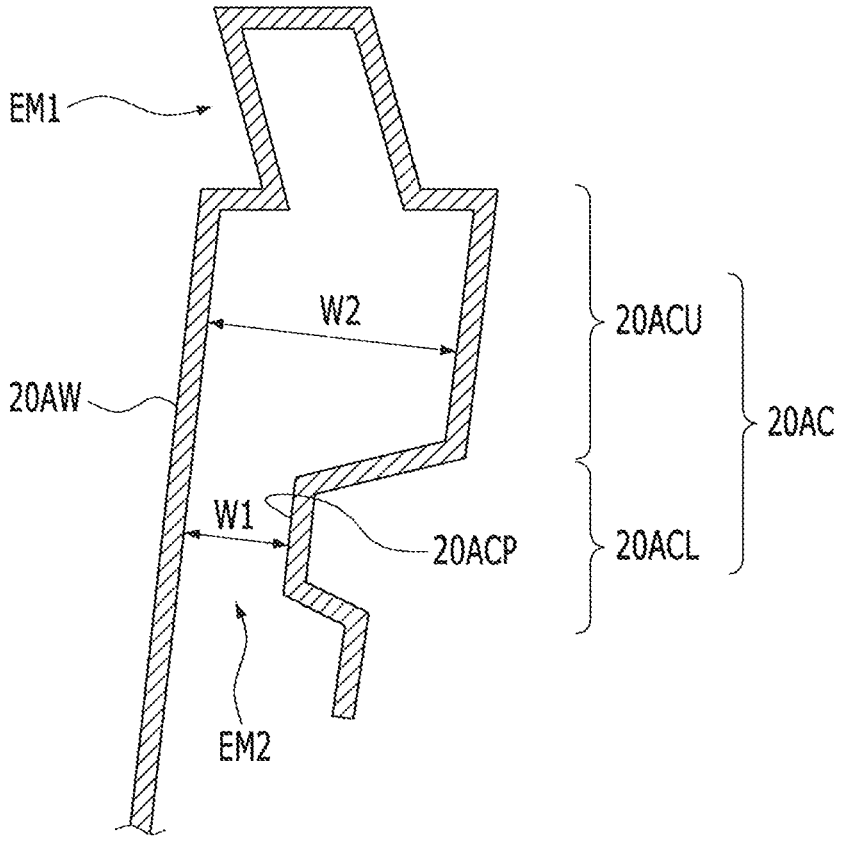
FIG. 8A shows a close-up sectional view of a portion M2 of the container BIB of FIG. 3.

FIG. 8A shows a close-up sectional view of a portion M2 of the container BIB of FIG. 3.

Figure 8B:
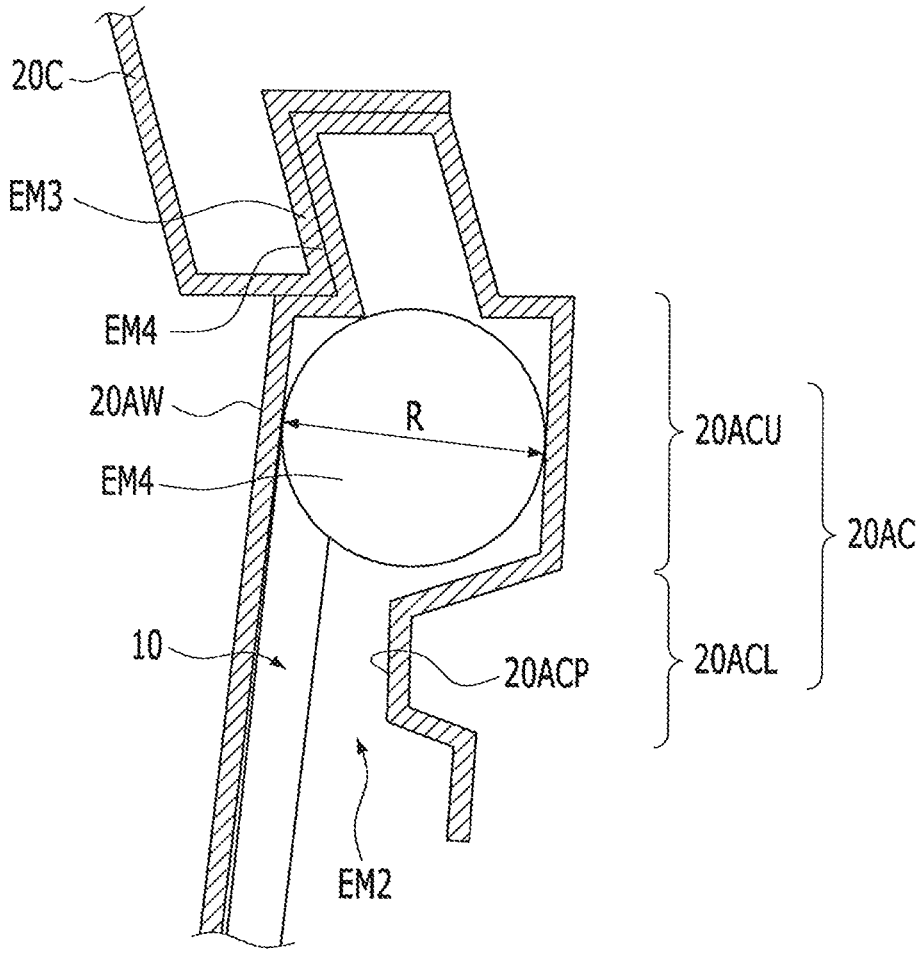
FIG. 8B shows a close-up sectional view of a portion M4 of the container BIB of FIG. 7.

FIG. 8B shows a close-up sectional view of a portion M4 of the container BIB of FIG. 7.

Figure 9:
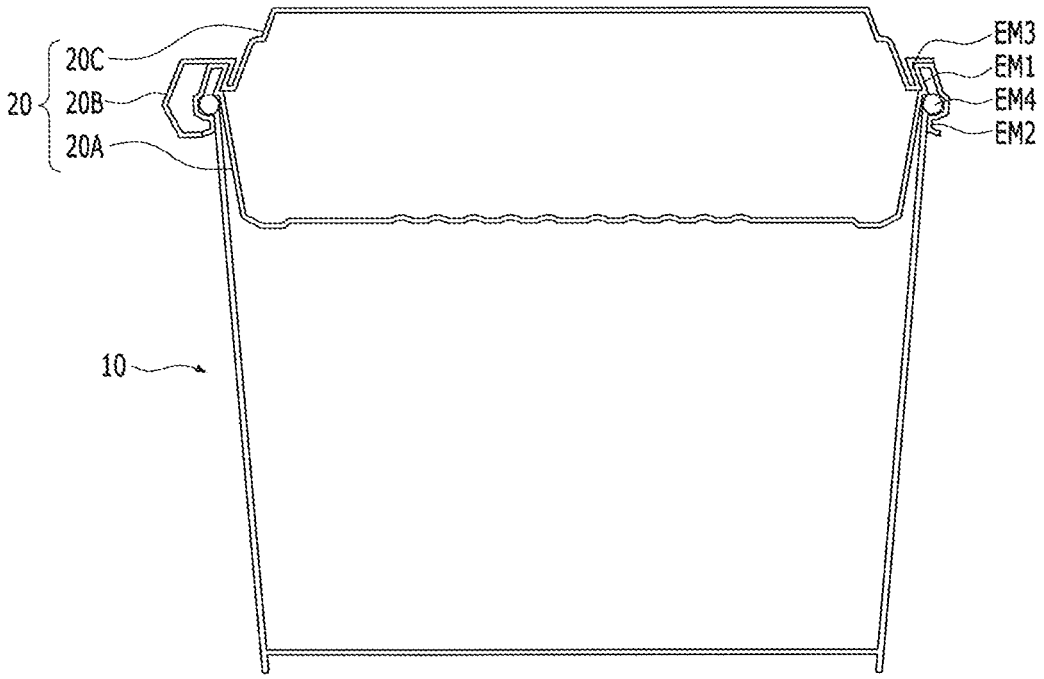
FIG. 9 shows a sectional view of the container BIB of FIG. 7.

FIG. 9 shows a sectional view of the container BIB of FIG. 7.

Referring to FIGS. 7 to 9, the second container 20' can be inserted into the first container 10 and occupied an upper part of the first interior volume of the first container 10.

By engaging between the second and the fourth engaging mean EM2, EM4, the first and the second container 10, 20 are fixed to each other and the first interior volume of the first container 10 can be sealed.

The second engaging mean EM2 may be the second groove formed between the side wall 20AW and the outer collar 20AC of the bowl 20A. In this case, the fourth engaging mean EM4 may be the rim rolled outwardly from a top end of the sidewall of the first container 10.

Specifically, a gap distance between the side wall 20AW and the outer collar 20AC is narrower in a lower portion 20ACL than that in an upper portion 20ACU in at least part. Also, a gap distance between the side wall 20AW and the lower portion 20ACL is narrower than a diameter R of the rim, the fourth engaging mean EM4. In other words, the second groove may have a protrusion 20ACP projected toward the sidewall 20AW on an entrance of the second groove, and thereby the entrance of the second groove is narrower than an interior room of that.

In some embodiments, there are at least two gap distances between the side wall 20AW and the outer collar 20AC. Accordingly, a cross section of the outer collar 20AC may has a square zig gap shape.

The at least two gap distances include a first gap distance W1 between a lower portion 20ACL of the outer collar 20AC, and a second gap distance W2 between an upper portion 20ACU of the outer collar 20AC. In this case, the first gap distance W1 is narrower than the second gap distance W2 to engage with the rim, the fourth engaging mean EM4 tightly. Furthermore, the first gap distance W1 may be same as or narrower than a diameter R of the rim. In this case, the outer collar 20AC can be slightly splayed outward.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A container having multiple compartments, the container comprising: a first container having a first interior volume; a second container having a bowl, a second interior volume defined by the bowl, and a lid, and inserted into and occupied a part of the first interior volume, wherein the second container includes a first engaging mean located along an inner edge of the bowl, and a second engaging mean located along an outer edge of the bowl; wherein the first engaging mean engages with a third engaging mean located along an edge of the lid, and wherein the second engaging mean engages with a fourth engaging mean located along an upper edge of the first container, wherein the bowl includes a floor and a side wall extending upwardly from the floor, wherein the first engaging mean is a first groove located along the inner edge of an upper portion of the side wall, wherein the third engaging mean is a protrusion engageable with the first groove, wherein the bowl further includes an outer collar extending outwardly from a top end of the side wall, and wherein the second engaging mean is a second groove formed between the side wall and the outer collar.

2. The container of claim 1, wherein, by engaging between the second and the fourth engaging mean, the first container and the second container are fixed to each other and the first interior volume is sealed.

3. The container of claim 1, wherein the first groove has a step shape having a tread and a front face, and an angle between the tread and the front face is acute, and wherein the protrusion has a bottom and an outer face, and an angle between the bottom and the outer face is obtuse.

4. The container of claim 1, wherein a gap distance between the side wall and the outer collar is narrower in a lower portion of the outer collar than that in an upper portion in at least part.

5. The container of claim 4, wherein the first container includes a rim rolled outwardly on a top end of the first container, and wherein a gap distance between the side wall and the lower portion of the outer collar is narrower than a diameter of the rim.

6. The container of claim 1, wherein a gap distance between the side wall and the outer collar is narrower in a lower portion of the outer collar than that in an upper portion in at least part.

7. The container of claim 6, wherein the first container includes a rim rolled outwardly on a top end of the first container, and wherein a gap distance between the side wall and the lower portion of the outer collar is narrower than a diameter of the rim.

8. The container of claim 1, wherein the outer collar includes a plurality of protrusions projected toward the side wall.

9. The container of claim 1, wherein there are at least two gap distances between the side wall and the outer collar.

10. The container of claim 9, wherein the first container includes a rim rolled outwardly on a top end of the first container, wherein the at least two gap distances include a first gap distance between a lower portion of the outer collar, and a second gap distance between an upper portion of the outer collar, and wherein the first gap distance is narrower than the second gap distance, and the second gap distance is same as or narrower than a diameter of the rim.

11. The container of claim 9, wherein a cross section of the outer collar has a square zig gap shape.

12. The container of claim 1, wherein the lid is connected to the bowl through a bridge.

13. The container of claim 1, wherein the lid, the bowl, and the bridge are made of same elastic material.

14. The container of claim 1, wherein the first interior volume is sealed by engaging between the second and the fourth engaging mean, and the second interior volume is sealed by engaging between the first and the third engaging mean.

15. A container having a dual engaging mean, the container comprising: a first container; a second container inserted into and occupied a part of an interior volume of the cup, the second container comprising: a bowl including one of a first engaging pair located along an inner edge, and one of a second engaging pair located along an outer edge, and a lid including the other of the first engaging pair located along an edge of the lid, and wherein the cup includes the other of the second engaging pair located along an upper edge of the cup, wherein, by the second engaging pair engaging each other, the cup and the second container are fixed to each other and the cup is sealed, wherein by the first engaging pair engage each other, the second container is sealed, wherein the bowl includes a floor and a side wall extending upwardly from the floor, wherein the first engaging mean is a first groove located along the inner edge of an upper portion of the side wall, wherein the third engaging mean is a protrusion engageable with the first groove, wherein the bowl further includes an outer collar extending outwardly from a top end of the side wall, and wherein the second engaging mean is a second groove formed between the side wall and the outer collar.

16. The container of claim 15, wherein the one of a first engaging pair is a step groove having a tread and a front face, and the other of the first engaging pair is a protrusion having a bottom and an outer face, and wherein an angle between the tread and the front face is acute, and an angle between the bottom and the outer face is obtuse.

17. The container of claim 16, wherein the cup includes a rim rolled outwardly on a top end of the cup, and wherein a first gap distance between the side wall and a lower portion of the outer collar is narrower than a second gap distance between the side wall and an upper portion of the outer collar in at least part and a diameter of the rim.

* * * * *